US010851525B2

(12) United States Patent
Kinikarslan et al.

(10) Patent No.: US 10,851,525 B2
(45) Date of Patent: Dec. 1, 2020

(54) COVERING SYSTEM WITH REDUCED RATTLING TENDENCY FOR FLUSH-MOUNTED CONTROLS

(71) Applicant: Grohe AG, Hemer (DE)

(72) Inventors: Turgut Kinikarslan, Witten (DE); Hartwig Philipps-Liebich, Menden (DE)

(73) Assignee: Grohe AG, Hemer (DE)

( * ) Notice: Subject to any disclaimer, the term of this patent is extended or adjusted under 35 U.S.C. 154(b) by 0 days.

(21) Appl. No.: 15/918,756

(22) Filed: Mar. 12, 2018

(65) Prior Publication Data

US 2018/0258620 A1 Sep. 13, 2018

(30) Foreign Application Priority Data

Mar. 10, 2017 (DE) ..... 10 2017 105 189

(51) Int. Cl.

| | |
|---|---|
| ***E03B 7/09*** | (2006.01) |
| ***E03C 1/042*** | (2006.01) |
| ***E03B 7/04*** | (2006.01) |

(52) U.S. Cl.

CPC ..... *E03B 7/095* (2013.01); *E03C 1/042* (2013.01); *E03B 7/04* (2013.01); *E03C 2201/50* (2013.01)

(58) Field of Classification Search

CPC . E03B 7/095; E03B 7/04; E03C 1/042; E03C 2201/50

See application file for complete search history.

(56) References Cited

U.S. PATENT DOCUMENTS

| | | | | | |
|---|---|---|---|---|---|
| 2,870,794 | A * | 1/1959 | Thaxton | F16L 55/136 | 138/90 |
| 3,421,648 | A * | 1/1969 | Giessler | B65D 51/20 | 215/276 |
| 2006/0091099 | A1* | 5/2006 | Klepac | B65D 45/305 | 215/276 |
| 2012/0297572 | A1* | 11/2012 | Stewart | H02G 3/22 | 16/2.2 |
| 2013/0283524 | A1* | 10/2013 | Schulte | E03C 1/06 | 4/695 |
| 2016/0265203 | A1* | 9/2016 | Knapp | E03F 5/0408 | |

FOREIGN PATENT DOCUMENTS

| | | | | |
|---|---|---|---|---|
| DE | 102 19 471 | A1 | 11/2003 | |
| DE | 10 2013 003 823 | A1 | 9/2014 | |
| DE | 102013003823 | A1 * | 9/2014 | E03C 1/021 |
| DE | 102015002896 | A1 * | 9/2016 | E03C 1/021 |
| DE | 10 2015 009 105 | A1 | 1/2017 | |
| EP | 3162970 | A1 * | 5/2017 | E03C 1/042 |
| WO | WO-2015055901 | A1 * | 4/2015 | E03C 1/021 |
| WO | WO-2018130711 | A1 * | 7/2018 | E03C 1/0412 |

* cited by examiner

*Primary Examiner* — Basil S Katcheves
*Assistant Examiner* — Omar F Hijaz
(74) *Attorney, Agent, or Firm* — Muncy, Geissler, Olds & Lowe, P.C.

(57) ABSTRACT

A covering system is provided having a cover, with a first mounting geometry at least partially running circumferentially around the cover, a carrier plate designed to attach the cover, a seal at least partially running circumferentially around the carrier plate, and an elastic mounting geometry that is formed on the seal. The first mounting geometry and the elastic mounting geometry are designed and arranged for positive engagement with each other.

14 Claims, 3 Drawing Sheets

COVERING SYSTEM WITH REDUCED RATTLING TENDENCY FOR FLUSH-MOUNTED CONTROLS

This nonprovisional application claims priority under 35 U.S.C. § 119(a) to German Patent Application No. 10 2017 105 189.9, which was filed in Germany on Mar. 10, 2017, and which is herein incorporated by reference.

BACKGROUND OF THE INVENTION

Field of the Invention

The invention relates to a covering system, comprising as components a cover, with a first mounting geometry at least partially running circumferentially around the cover; a carrier plate designed for attaching the cover; an elastic mounting geometry at least partially running circumferentially around the carrier plate; wherein the first mounting geometry and the elastic mounting geometry are designed and arranged to form a positive engagement with each other, a method employing this, and the use of the covering system.

Description of the Background Art

Most components of modern home technology, especially pipework, are provided invisibly in buildings. To this end, they are mounted in walls or in ducts. Yet it is necessary to provide control elements for the operation of the home technology. It is preferred that these also only show the part of the control that is necessary for operation. The other part which contains the actual function is, just like other components of home technology, provided "behind the wall". For this purpose, it is often necessary to provide holes in walls that accommodate these controls and other components of home technology. A number of commercial covering systems that typically use cover rosettes as a cover, are known in the art. In operating or servicing the controls, there is often contact between the operator and the cover of the covering system. This contact creates disturbing rattling noises, especially if the wall surface is laid out with grouted tiles.

SUMMARY OF THE INVENTION

The present invention forms the basis for helping eliminate one or more disadvantages resulting from the prior art. In particular, an object of the invention is to provide covering systems with lower noise while operating, which are also well suited for installing and maintaining the controls without the additional need for tools.

In an exemplary embodiment, a covering system is provided that includes a cover, a first mounting geometry at least partially running circumferentially around the cover; a carrier plate designed for attaching the cover; and an elastic mounting geometry which at least partially encircles the carrier plate. The first mounting geometry and the elastic mounting geometry are designed and arranged to form a positive engagement with one another.

The first mounting geometry surrounds the cover up to at least 50%, preferably at least 70% and particularly preferably at least 90%. It is further preferred that the elastic mounting geometry surrounds the cover up to at least 50%, preferably at least 70% and more preferably at least 90%. Furthermore, it is preferred that the elastic mounting element is part of a seal. Preferably, the elastic mounting element is formed integrally with the seal.

In an embodiment, the elastic mounting geometry has a lip. In this case, it is preferred that if the covering system is installed, the lip touches the wall. In addition, it is preferred that if the covering system is built in, the cover touches the lip. If the covering system is built in, the lip is preferably designed to avoid direct contact between the cover and the wall. Preferably, the lip is substantially formed as a triangle, wherein the base of the triangle forms part of the mounting geometry, and if the distribution system is built in, the two legs of this triangle touch the wall and the cover. Preferably, the lip surrounds at least 50%, preferably at least 70% and particularly preferably at least 90% of the circumference of the mounting geometry. This way, it can be achieved that if the covering system is built in, the lip avoids direct contact between wall and cover in as many areas between cover and wall.

In an embodiment, the elastic mounting geometry has a snap geometry configured and designed to snap into the first mounting geometry. The snap geometry is preferably designed as a bulge. If the covering system is built in, this bulge is preferably located farther away from the wall as compared to the lip. Furthermore, it is preferred that when placing the cover on the carrier plate, a part of the snap geometry, in particular the bulge, is pressed in, and again relaxed when the cover is moved further towards the wall.

In an embodiment, the elastic mounting geometry is formed from an elastomer. If the elastic mounting geometry is part of a seal, it is also preferably formed from an elastomer. Suitable elastomers are, in particular, those which permit reversible impressions by manual force. This way, the cover can be form-fittingly placed on the snap geometry of the elastic mounting geometry and connected thereto without the use of special tools. Furthermore, the selection of such elastomers also allows for the release of the cover by hand without the use of special tools. Preferred are elastomers which, after the irreversible impressing, require a period ranging from 1-20 seconds, preferably ranging from 1-5 seconds and more preferably ranging from 1-3 seconds, until they reach the initial position prior to the irreversible impression. Particularly preferred elastomers are thermoplastic elastomers.

According to an embodiment, the elastomer may be present as a foam. It is preferred here that the surface of these foams is sealed. Preferably, the elastic mounting geometry is integrally formed and therefore also preferably substantially completely formed from the elastomer.

In an embodiment, the elastomer is selected from rubber, polyisoprene, polybutadiene, polyurethane and polysilane, or a combination of at least two thereof. In an embodiment, the elastomer according to the invention includes a mixture of at least two of the aforementioned elastomers. In an embodiment, the elastomer according to the invention includes a copolymer. Preferably, such copolymers are formed from two or more monomers selected from, for example, ethylene, propylene, butadiene and/or isoprene. In this context, in particular, ethylene propylene diene rubber should be specified.

In an embodiment, the first mounting geometry is more rigid than the elastic mounting geometry. The first mounting geometry or also the cover are preferably formed of a material such as metal or hard plastic. When choosing this material, it is preferred that this material should be rigid enough that it is adapted to impress the elastomer discussed above without itself being impressed or deformed in some other fashion. Typical metals in this context are steel, in particular sheet steel, or aluminum. Preferred plastics here are polystyrene, acrylonitrile butadiene styrene copolymer, polypropylene, polyamide, polycarbonate and other thermoplastics.

In an embodiment, the first mounting geometry has a recess or a curvature or both, each configured and designed for the positive reception of the elastic mounting geometry. In this context, it is preferred that the curvature is formed such that when the cover is pushed open with the first mounting geometry onto the elastic mounting geometry, the curvature presses into the elastomer. If a recess is provided in the first mounting geometry, this, as compared to the curvature, is preferably located closer to the wall. The recess allows the previously impressed elastomer to relax. Thus, the first mounting geometry is fixed in position by the elastic mounting geometry. A first mounting geometry, preferably designed hook-like in cross section, interlocks after pressing in and gliding over the bulge of the elastic mounting geometry, in which the bulge relaxes in the recess of the first mounting geometry.

In an embodiment, the part of the cover which faces the wall if the covering system is wall mounted, is separated from the wall by at least one separator of the elastic mounting geometry, which is located between the wall and the cover. Preferably, the separator is designed in the form of a lip. The embodiments above in connection with the lip apply here in the same way.

In an embodiment, the carrier plate comprises a further seal at least partially running circumferentially around the carrier plate. The further seal is preferably formed from an elastomer. Therefore, in this context, the above embodiments also apply here. Preferably, the further seal is mounted in the region of the carrier plate, which, if it is mounted in a hole, is received by the latter. Preferably, the further seal seals the carrier plate against this wall of the hole. Also in connection with the further seal, it is preferred that it surrounds the area of the carrier plate received through the wall opening up to at least 50%, preferably at least 70% and particularly preferably at least 90%. Here, too, this measure can ensure that the carrier plate is sealed against the hole or the wall at as many points thereof as possible.

In one embodiment, the further seal comprises a sealing surface having a groove. This design of the surface supports a form-fitting or frictional anchoring of the carrier plate in the wall opening. Preferably, the grooves are formed on the sealing surface by circumferential rings.

In an embodiment, a control element is provided as a further component. The control element is preferably designed as a mixer or valve. Another preferred type of controls are consumption meters. It is equally preferable that two and more controls are incorporated in the covering system of the invention. As a result, the control or the controls can provide safe and visually appealing flush-mounted units.

In an embodiment, the covering system is provided in a wall. The walls are preferably located in sanitary rooms or housekeeping rooms. Preferred sanitary rooms are bathrooms and toilets. Preferred housekeeping rooms are kitchens, utility rooms or laundry rooms.

A method is also provided for manufacturing a flush-mounted device, including the steps for providing a wall with a hole, and closing the hole with the covering system.

The wall with the hole can be provided at work sites of buildings, especially during their construction or renovation. Usually, a pipe system is hidden behind the wall, which conduct in particular water, preferably hot water and cold water, gas or other utility supplies of a building. The utility supplies conducted in this pipe system are regulated via controls, preferably valves or mixers. Essential parts of these controls are located behind the wall or in the hole. This hole must now be closed, whereby the covering system according to the invention closes the hole, preferably by covering or inserting or both. Preferably, the closing takes place in such a way that the hole is no longer visible. Furthermore, the hole can be sealed against moisture and dust.

The covering system also reduces noise. Noises to be considered are in particular those that arise when the cover is touched while operating the controls. This includes, in particular, rattling noises which occur, for example, when the operator touches the cover. Such rattling noises occur especially on wall surfaces with tiles and especially if there are joints between the tiles.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
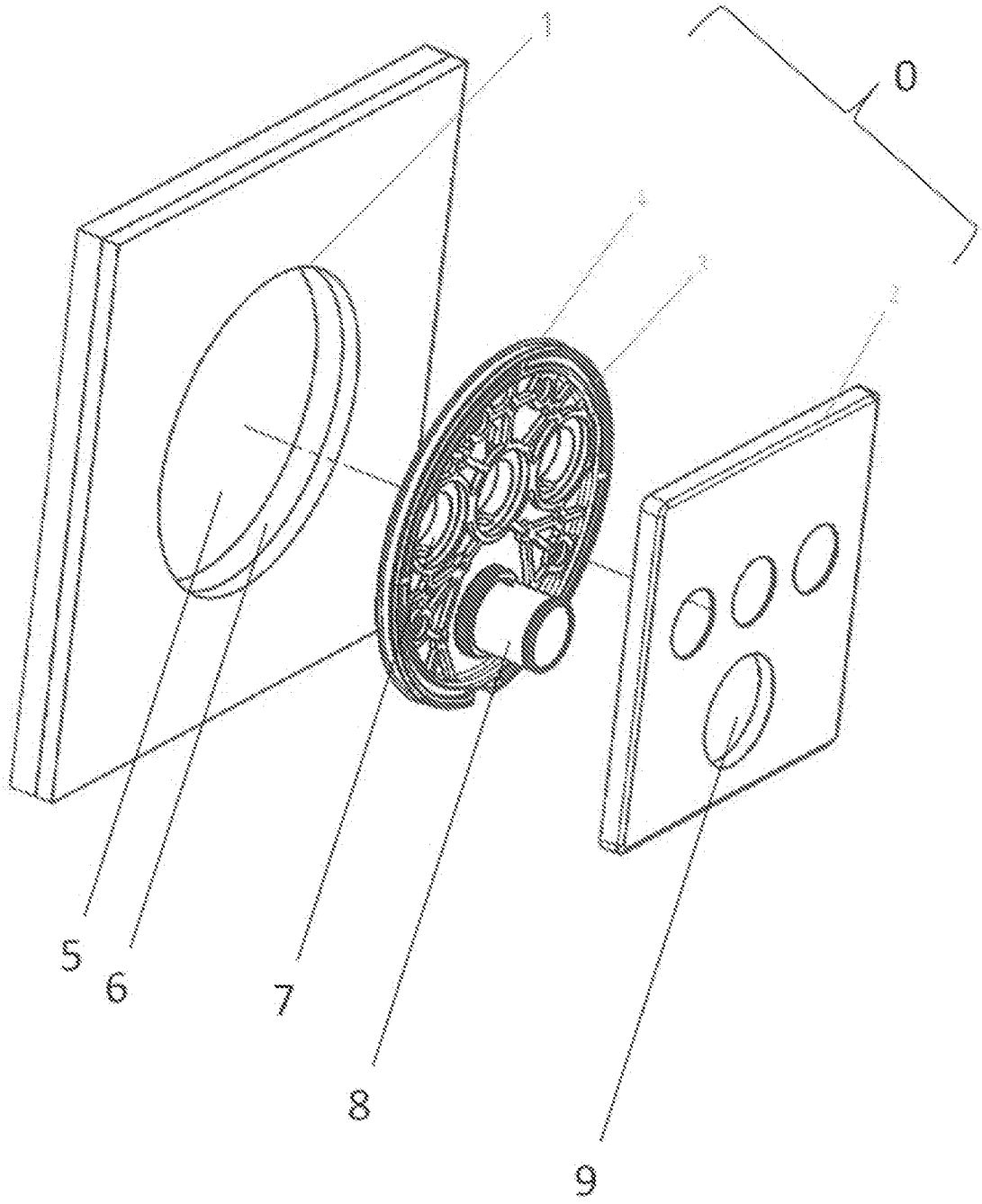
FIG. 1 is a schematic representation of a covering system according to the invention.

FIG. 1 shows a schematic representation of a covering system 0 according to the invention. The covering system 0 according to the invention was used to cover a hole 5 in a wall 1. The covering system 0 has a carrier plate 3. The carrier plate 3 is configured and designed so that it is flush with the walls 6 of the hole 5 or covers it with its larger surface. The carrier plate has one or more recesses 7, in which controls 8 can be received. The carrier plate 3 has a seal with an elastic mounting geometry 4. The seal 4 runs along the edge of the carrier plate 3. Further, the covering system 0 has a cover 2. The cover 2 is configured and designed such that it at least covers the surface of the carrier plate 3. The cover 2 has one or more further recesses 9, which like the recesses 7 are adapted for receiving a plurality of controls 8.

Figure 2:
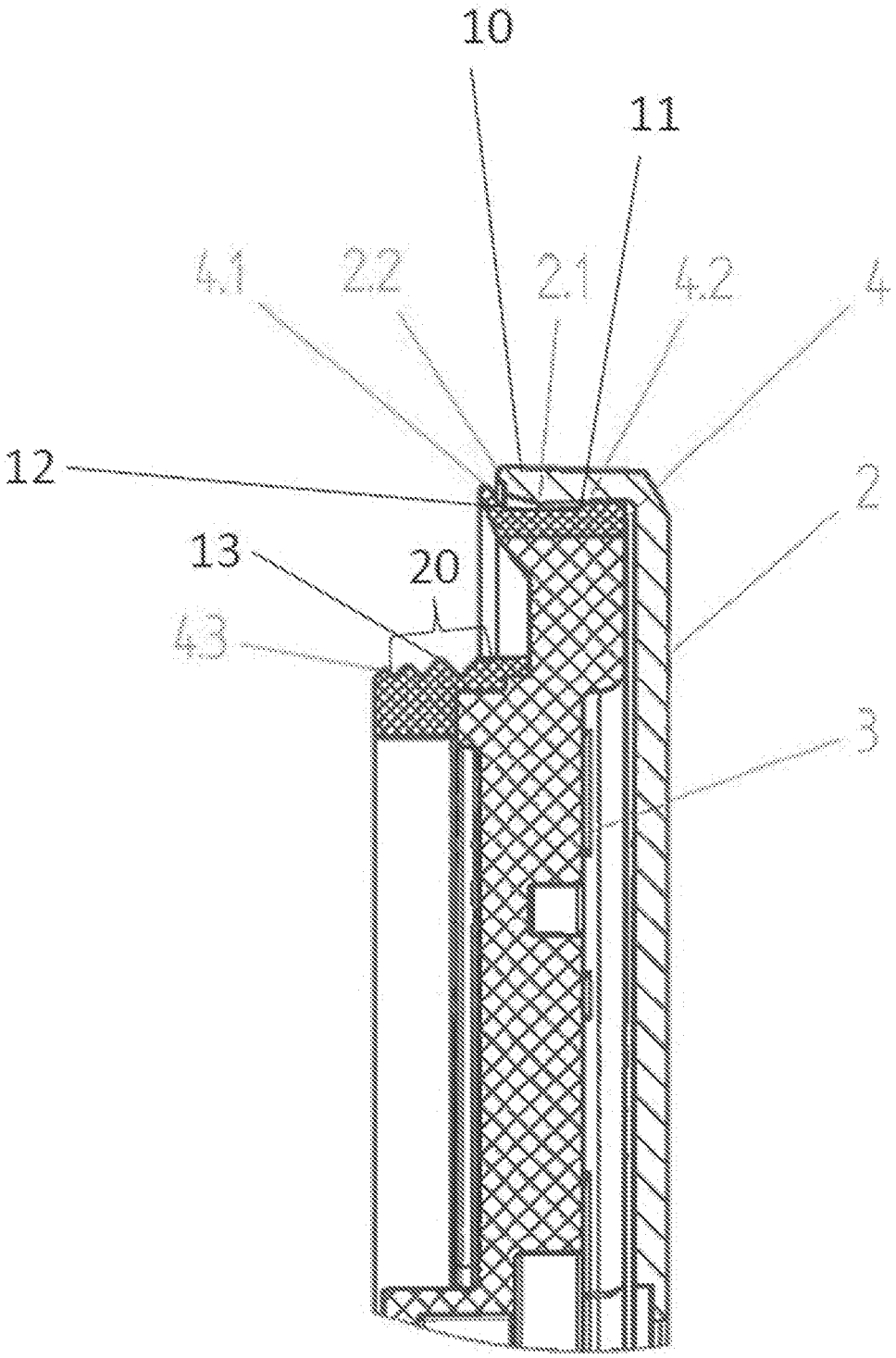
FIG. 2 is a schematic cross-sectional view of a covering system according to the invention.

FIG. 2 shows a schematic cross-sectional illustration of a covering system 0 according to the invention. The cover 2 has a cover wall 10 which surrounds the cover 2 and has an inner surface 11. Parts of the inner surface 11 press on a surface 12 of the elastic mounting geometry 4.2 on the carrier plate 3 to form a positive connection. Furthermore, the elastic mounting geometry 4.2 has a lip 4.1. This lip 4.1 is provided between an edge 2.2 of the cover wall 10 and the wall 1. The lip 4.1 is intended to make it more difficult for the edge 2.2. to abut the wall 1. Furthermore, the carrier plate 3 has a seal 4.3. As compared to the elastic mounting geometry 4.2, the seal 4.3 starts farther away from the inner surface 11 and, if installed in the hole 5 of the wall 1, is at least partially received by the hole 6, wherein the seal 4.3 is positively or frictionally connected via a groove 14 with the wall 6 of the hole 5.

Figure 3:
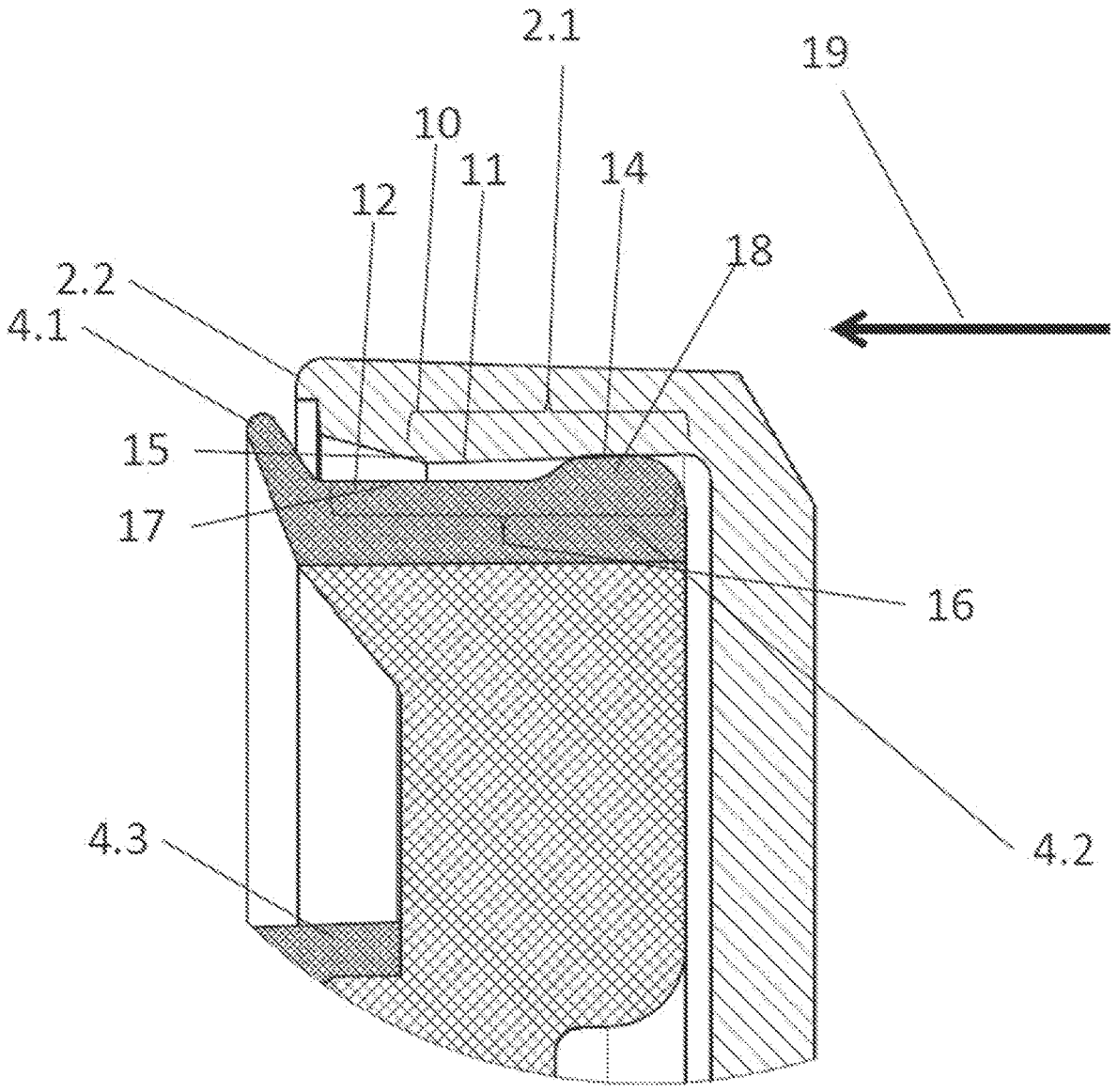
FIG. 3 is a schematic cross-sectional view of a portion of the covering system according FIG. 2.

FIG. 3 shows a schematic cross-sectional view of a section of the covering system 0 according to the invention from FIG. 2. Unless reference numerals were used in the figure description of FIG. 3, reference is made to the embodiments in FIG. 2. The elastic mounting geometry 4.2 has a snap geometry 16. As viewed from the wall 1, the snap geometry 16 follows the lip 4.1. In the snap geometry 16, as viewed from the wall 1, first a depression 17 is formed, followed by a bulge 18. For the positive connecting with the elastic mounting geometry 4.2, the cover wall 10 has a first mounting geometry 2.1. As viewed in the direction of thrust 19, the first mounting geometry 2.1 has a recess 14 followed by a curvature 15. When placing the cover 2 on the carrier plate 3, the cover 2 is moved in the direction of thrust 19 while the curvature 15 first presses the elastic bulge 18 together. The curvature 15 the slides further into the depression 17, wherein the bulge 18 relaxes in the recess 14.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A covering system comprising a cover;

the cover having a first mounting geometry provided at least partially around a circumference thereof;

a carrier plate adapted to be attached to the cover, the carrier plate including a seal; and the seal being an elastic mounting geometry at least partially running circumferentially around the carrier plate, wherein a portion of each of the first mounting geometry and the elastic mounting geometry are in positive engagement with each other, wherein the elastic mounting geometry further includes a lip that protrudes at an angle from one end of the seal, such that the lip is angled away from the cover, wherein the cover is a single, monolithic element having a U-shaped cross-section, wherein the carrier plate is partially mounted inside the cover in a space formed by the U-shaped cross-section, wherein the carrier plate comprises a further seal at least partially running circumferentially around the carrier plate, and wherein the further seal has a sealing surface comprising a groove.

2. The covering system according to claim 1, wherein the elastic mounting geometry has a snap geometry which is configured to snap into the first mounting geometry.

3. The covering system according to claim 1, wherein the elastic mounting geometry is formed from an elastomer.

4. The covering system according to claim 3, wherein the elastomer is selected from rubber, polyisoprene, polybutadiene, polyurethane, or polysilane or a combination of at least two thereof.

5. The covering system according to claim 1, wherein the first mounting geometry is more rigid than the elastic mounting geometry.

6. The covering system according to claim 1, wherein the first mounting geometry comprises a recess or a curvature or both, and wherein the first mounting geometry is configured for positively receiving the elastic mounting geometry.

7. The covering system according to claim 1, wherein if the covering system is wall mounted, a part of the cover facing the wall is separated from the wall by at least the lip of the elastic mounting geometry that is situated between the wall and the cover.

8. The covering system according to claim 1, comprising a control element as a further component.

9. The covering system according to claim 1, wherein the covering system is provided in a wall.

10. A method for manufacturing a flush-mounted device, the comprising:

providing a wall with a hole; and closing the hole with the covering system according to claim 1.

11. The covering system according to claim 1, wherein the covering system reduces noise.

12. The covering system according to claim 1, wherein the further seal is radially spaced apart from the seal.

13. The covering system according to claim 1, wherein the elastic mounting geometry also includes a rounded bulge that protrudes from the seal at a second end thereof, and wherein the rounded bulge is retained in a recess of the first mounting geometry.

14. A covering system comprising a cover;

the cover having a first mounting geometry provided at least partially around a circumference thereof;

a carrier plate adapted to be attached to the cover, the carrier plate including a seal; and the seal being an elastic mounting geometry at least partially running circumferentially around the carrier plate, wherein a portion of each of the first mounting geometry and the elastic mounting geometry are in positive engagement with each other, wherein the elastic mounting geometry further includes a lip that protrudes at an angle from one end of the seal, such that the lip is angled away from the cover, wherein the cover is a single, monolithic element having a U-shaped cross-section, wherein the carrier plate is partially mounted inside the cover in a space formed by the U-shaped cross-section, wherein the cover includes a front wall having an outer surface and an inner surface and a side wall that extends perpendicularly from the inner surface of the front wall, the side wall having an outer surface and an inner surface, wherein the carrier plate includes a front wall having an outer surface and an inner surface and a side wall extending perpendicularly between the outer surface and the inner surface of the front wall of the carrier plate, and wherein the outer surface of the front wall of the carrier plate faces the inner surface of the front wall of the cover and the inner surface of the side wall of the cover faces the side wall of the carrier plate, and wherein the seal is provided on the side wall of the carrier plate such that the seal is wedged between the side wall of the carrier plate and the inner surface of the side wall of the cover.

* * * * *